US009980590B1

(12) United States Patent
Broadway

(10) Patent No.: US 9,980,590 B1
(45) Date of Patent: May 29, 2018

(54) DRINKING STRAW DEVICE TO IONIZE, FILTER AND FLAVOR DRINKING WATER

(71) Applicant: Marsais Broadway, Tulsa, OK (US)

(72) Inventor: Marsais Broadway, Tulsa, OK (US)

( * ) Notice: Subject to any disclaimer, the term of this patent is extended or adjusted under 35 U.S.C. 154(b) by 0 days. days.

(21) Appl. No.: 15/281,751

(22) Filed: Sep. 30, 2016

Related U.S. Application Data

(60) Provisional application No. 62/235,303, filed on Sep. 30, 2015.

(51) Int. Cl.

| | |
|---|---|
| ***G01F 15/00*** | (2006.01) |
| ***A47G 23/10*** | (2006.01) |
| ***A47G 21/18*** | (2006.01) |
| ***G01F 1/075*** | (2006.01) |

(52) U.S. Cl.
CPC ..... *A47G 23/10* (2013.01); *A47G 21/183* (2013.01); *A47G 21/188* (2013.01); *G01F 1/075* (2013.01)

(58) Field of Classification Search
CPC . G01F 1/56; G01F 1/115; G01F 23/14; B65D 88/54; B05B 12/00; A23L 1/00
See application file for complete search history.

(56) References Cited

U.S. PATENT DOCUMENTS

| | | | | |
|---|---|---|---|---|
| 4,921,713 | A | 5/1990 | Fowler | |
| 4,995,976 | A | 2/1991 | Vermes et al. | |
| 5,273,649 | A | 12/1993 | Magnusson et al. | |
| 5,772,017 | A * | 6/1998 | Kang | B65D 51/2842 206/222 |
| 6,811,036 | B1 | 11/2004 | Vaiano et al. | |
| 7,100,838 | B1 * | 9/2006 | Epstein | A47G 21/182 239/1 |
| 7,402,092 | B1 * | 7/2008 | Randall | A47G 19/2227 220/705 |
| 8,425,771 | B2 | 4/2013 | O'Brien et al. | |
| 8,757,011 | B2 * | 6/2014 | Isicovich | G01F 1/075 73/861.88 |
| 9,346,607 | B2 * | 5/2016 | Madjar | B65D 83/00 |
| 2003/0203075 | A1 * | 10/2003 | Taylor | A47G 21/18 426/85 |
| 2010/0159075 | A1 | 6/2010 | Baron | |

(Continued)

OTHER PUBLICATIONS

LifeStraw Personal Water Filter, http://eartheasy.com/lifestraw, Sep. 26, 2016.

(Continued)

*Primary Examiner* — Jewel V Dowtin
(74) *Attorney, Agent, or Firm* — Head, Johnson, Kachigian & Wilkinson, PC

(57) ABSTRACT

A drinking straw device capable of ionizing, filtering, and/or flavoring water as well as tracking a user's water intake. The device may be generally straw-shaped and may have an ionizer component, an internal carbon filter, and/or a flavoring compartment for housing a flavoring component. The device may further have an intake tracking device, such as an internal impeller that spins as fluid is drawn through the device. The device may track the number of time the impeller spins, and thus the amount of fluid that has passed through the device, and may transmit that information to a software application on a smartphone or other device. A user may thus ionize, filter, and flavor his or her water while tracking his or her water intake throughout the day.

33 Claims, 9 Drawing Sheets

(56) References Cited

U.S. PATENT DOCUMENTS

| | | | | |
|---|---|---|---|---|
| 2012/0271567 | A1* | 10/2012 | Da Pont | G01F 1/075 702/45 |
| 2015/0368086 | A1* | 12/2015 | Sacchetti | B67D 1/0888 222/192 |
| 2016/0163175 | A1* | 6/2016 | Jenkins | G08B 21/16 |
| 2017/0097254 | A1* | 4/2017 | Smith | G01F 23/14 |
| 2017/0252764 | A1* | 9/2017 | Huang | B05B 12/008 |

OTHER PUBLICATIONS

Alexapure Survival Spring personal water filter, http://www.alexapure.com/products/survival-spring/, Sep. 26, 2016.
Seychelle Pure Water Straw, http://store.seychelle.com/Pure_Water_Straw-REGULAR_Dinking_Straw.html, Sep. 26, 2016.
H2O Survival Travel Straw, http://h2osurvivalstraw.com/h2o-survival-travel-straw/, Sep. 26, 2016.
Clean Sip,http://www.cleansip.com/technology/,Sep. 26, 2016.
PUR 2 Stage Flavor Pitcher (Discontinued), https://www.filtersfast.com/P-PUR-CR-5000-Flavored-Water-Pitcher-Filter.asp, Sep. 26, 2016.
Moderna Smart Sipper and Snacker, http://www.modernaproducts.be/dogs/dinner-time/smart-sipper-smart-snacker/, Sep. 26, 2019.
Johnny Moo Intense Milk Flavoring Straws and Pods, http://johnnymoo.com/ , Sep. 26, 2016.
UniStraw, http://unistraw.com/, Sep. 26, 2016.
DYLN Alkaline Water Bottle, https://www.dyln.co/pages/living-alkaline-waterboftle, Sep. 26, 2016.
Sososu Alkaline Mineral Water Bottle, http://www.terapeak.com/worth/portable-alkalineionizer-water-bottle-24-oz-720-ml-by-susosutransform-n/172037722038/, Sep. 26, 2016.
Blue QQ Alkaline Natural Mineral Water Ionizer, http://www.blueqq.com.sg/about-blueqq.html, Sep. 26, 2016.
Alkamate, https://www.amazon.com/dp/B00CBKSCNY/ref=twister_B 00Q5J2Q02?_encoding=UTF8&psc=1, Sep. 26, 2016.
IonPod Stainless Steel, https://www.healthyhabits.com/product/ionpod/, Sep. 26, 2016.
Alkaline Energy Flask Ionizer Water Bottle, http://www.santeviaus.mybigcommerce.com/alkaline-energy-flaskblack/, Sep. 26, 2016.
H2GO Portable Water Ionizer, http://www.microwaterman.com/WaterMan-H2Go-Water-Ionizer/Waterman-H2Go-Portable-Water-Ionizer.html, Sep. 28, 2016.
4pcs Ehm Alkaline Hydrogen Portable Water Ionizer Stick, http://www.ebay.com/itm/4-PC-EHM-Alkaline-Hydrogen-Portable-Water-Ionizer-Stick-Great-Alkaline-Water-/141806175270, 9-282016.
Thermo Smart Lid, http://www.thermos.com/smartlid.aspx, Sep. 28, 2016.
Hidrate Spark Smart Water Bottle, http://hidratespark.com/?gclid=CJHGgY_css8CFcdlfgodWoYB_g, Sep. 28, 2016.
Life Fuels (Trade mark), https://www.lifefuels.co/bottle/index.html, Sep. 28, 2016.
H2O Pal, h2opal.com, Sep. 28, 2016.
Pryme Vessel, myvessyl.com, Sep. 28, 2016.
Ozmo, https://www.ozmo.io/shop/, Sep. 28, 2016.
My Hydrate, myhydrate.com, Sep. 28, 2016.

* cited by examiner

DRINKING STRAW DEVICE TO IONIZE, FILTER AND FLAVOR DRINKING WATER

CROSS REFERENCE

This is based on and claims priority to U.S. Application No. 62/235,303 filed Sep. 30, 2015.

BACKGROUND OF THE INVENTION

Field of the Invention

The invention relates generally to a drinking straw to ionize, filter, and flavor drinking water.

Description of the Related Art

Currently there are a number of solutions for increasing one's water intake. One of these solutions attempts to manually track how much water you are drinking, but this solution fails to meet the needs of the market because a person can easily forget to write down every sip. Furthermore, some people have trouble finding clean, high quality water that tastes good, or prefer their beverages to be flavored. Keeping bottled water with oneself at all times is inconvenient, particularly when traveling or at school or work.

Based on the foregoing, it is desirable to provide an apparatus that flavors, purifies, and tracks water consumption.

It is further desirable to provide such an apparatus that not only purifies water but also ionizes the water.

It is further desirable to provide such an apparatus that adds flavor to the water.

It is further desirable to provide such an apparatus that is portable and can be used with various water sources, including bottled water and tap water.

Therefore, there currently exists a need in the market for an apparatus that is a drinking straw device to ionize, filter, and flavor drinking water, which comes with an accompanying smart phone software application to track water consumption.

SUMMARY OF THE INVENTION

In general, in a first aspect, the invention relates to a drinking straw device comprising: a tubular body with a top end and a bottom end; an impeller positioned such that fluid passing through the body makes the impeller spin; and a processor capable of calculating how much fluid has passes through the body based on how many times the impeller spins. The device may further comprise one or more magnets in the impeller and a hall effect sensor positioned such that it is capable of sensing the magnets in the impeller as the impeller spins. The hall effect sensor may be in communication with the processor. The device may further comprise a transmitter, such as a Bluetooth transmitter, where the transmitter is likewise in communication with the processor. A software application may be in communication with the processor via the transmitter such that the software application is capable of tracking a user's ingestion of fluid through the body based on how many times the impeller spins.

The body may comprise an ionizer. A filter, such as a carbon filter, may be located within the body. The filter may be held in place by an end cap, which may be removably attached to the bottom end of the body by friction fit, where the end cap has at least one aperture therethrough. The device may further comprise a housing attached to the top end of the body and a flavor component within the housing. The housing may be generally tubular and generally coaxial with the body.

The drinking straw device may further comprise a tip attached to the top end, where: the impeller is located within the tip; the tip has an open base and an opposing aperture; the base is in fluid communication with the aperture such that fluid entering the tip at the base is capable of exiting the tip at the aperture; the impeller is located between the base and the aperture; and the tip is in fluid communication with the body such that fluid is capable of flowing into the bottom end of the body, through the body, though the tip, and out the aperture in the tip. The flavor component housing may be located between the top end of the body and the base of the tip and in fluid communication with the body and the tip such that fluid is capable of flowing into the bottom end of the body, through the body, through the housing, though the tip, and out the aperture in the tip.

In a second aspect, the invention relates to a hydration tracking system comprising a drinking straw device comprising a tubular body with a top end and a bottom end; a tip attached to the top end, where the tip is in fluid communication with the tubular body and where the tip has an aperture such that fluid is capable of entering the device at the bottom end of the tubular body, traveling through the tubular body, traveling through the tip, and exiting the device through the aperture; and a fluid tracking device located within the tip; and a software application in communication with the fluid tracking device. The fluid tracking device may comprise: an impeller located within the tip such that fluid passing through the tip makes the impeller spin; one or more magnets imbedded in the impeller; a hall effect sensor positioned such that the hall effect sensor is capable of sensing rotation of the impeller via the magnets; a processor in communication with the hall effect sensor; a transmitter in communication with the processor, were the software application is in communication with the fluid tracking device via the transmitter; and a power source. The tip may further comprise a cover defining a cavity not in fluid communication with the body, where the cavity houses the hall effect sensor, processor, transmitter, and power source. The system may further comprise a flavor component housing located between and in fluid communication with both the body and the tip and/or a filter located within the tubular body.

Figure 1:
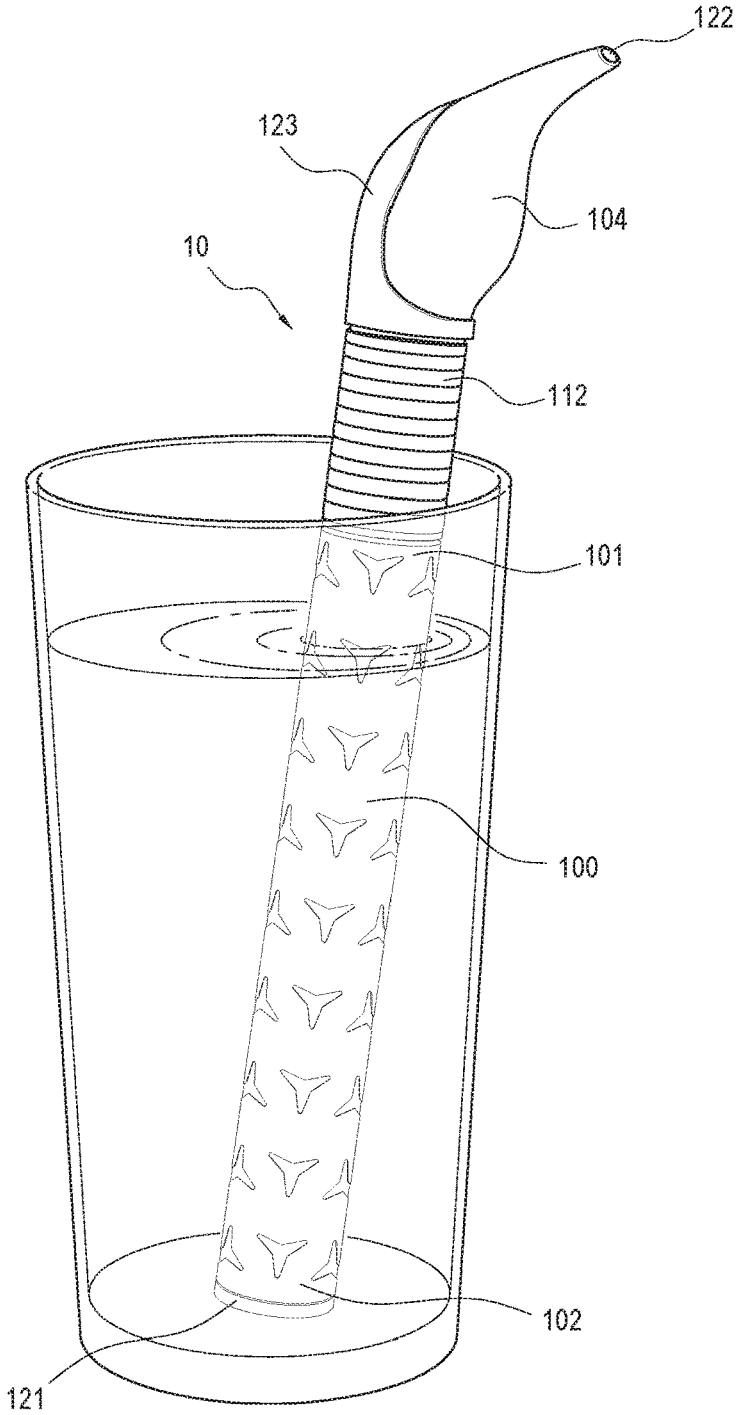
FIG. 1 is a perspective view of the drinking straw of the present invention in use in a glass of water.
Figure 2:
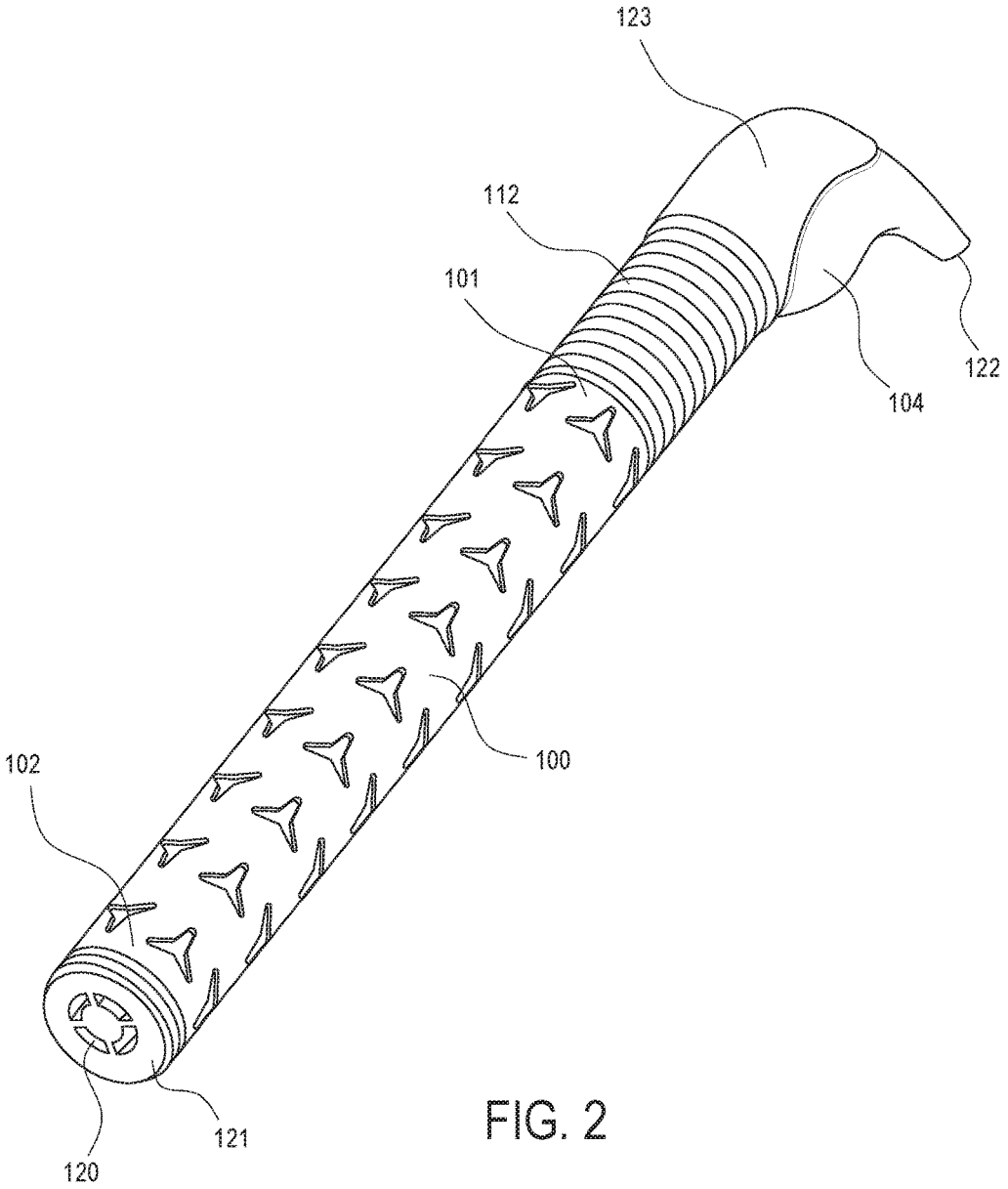
FIG. 2 is a perspective view of the drinking straw.
Figure 3:
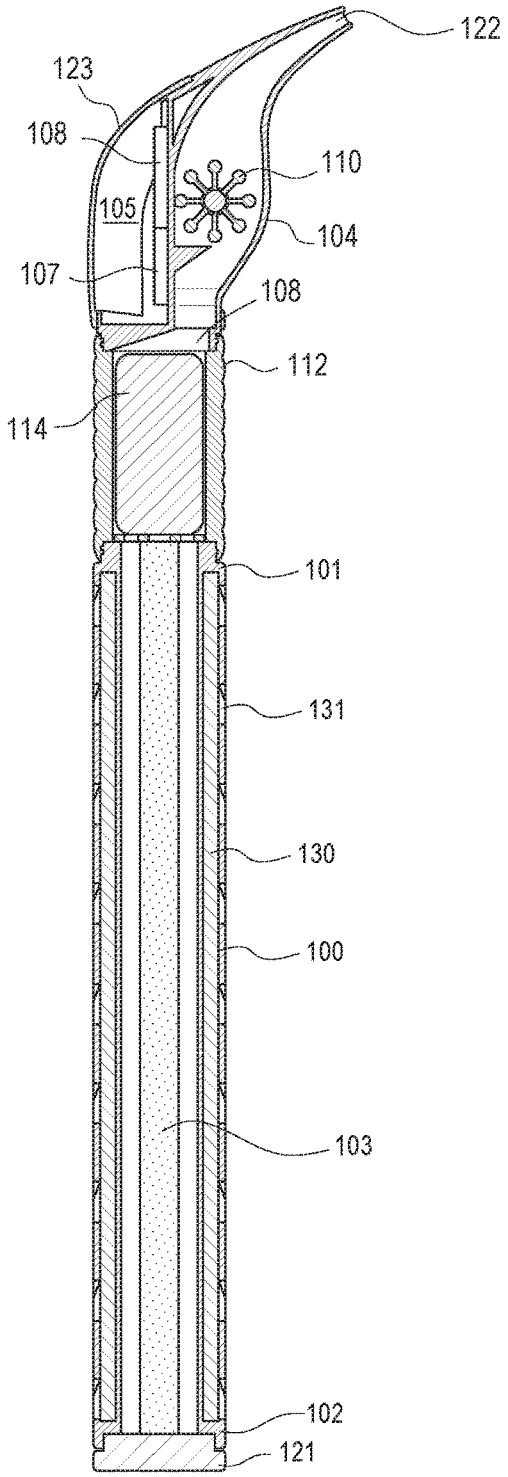
FIG. 3 is a side section view of the drinking straw.
Figure 4:
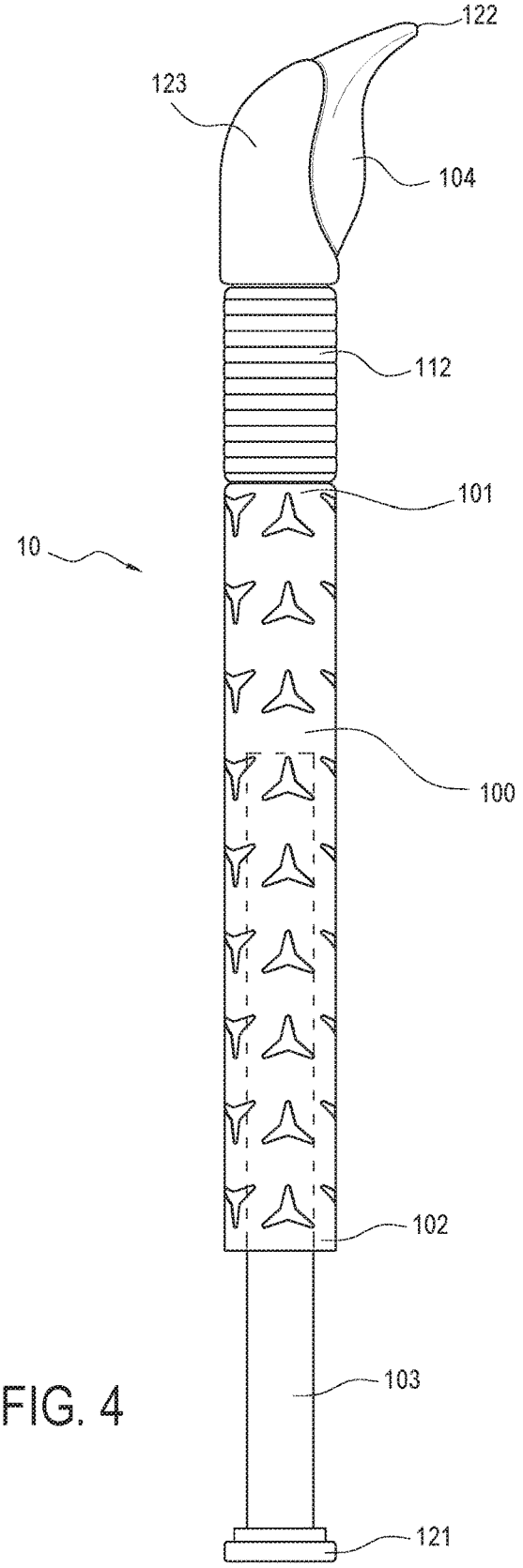
FIG. 4 is a side view of the drinking straw with the internal carbon filter pulled partway out, the portion of the carbon filter remaining within the straw body shown in dashed lines.

Other advantages and features will be apparent from the following description and from the claims.

DETAILED DESCRIPTION OF THE INVENTION

The devices and methods discussed herein are merely illustrative of specific manners in which to make and use this invention and are not to be interpreted as limiting in scope.

While the devices and methods have been described with a certain degree of particularity, it is to be noted that many modifications may be made in the details of the construction and the arrangement of the devices and components without departing from the spirit and scope of this disclosure. It is understood that the devices and methods are not limited to the embodiments set forth herein for purposes of exemplification.

In general, in a first aspect, the invention relates to a drinking straw device which may ionize, filter, and flavor drinking water. The invention may further comprise an accompanying smart phone software application to track water consumption. The device may have a main body comprising an alkalizer/ionizer to impart alkalinity to the consumer water and a carbon filter to ensure the user is drinking pure, filtered water. The alkalizer may be fashioned around the carbon filter. Specifically, the alkalizer may be tubular shaped, and the carbon filter may slide into the center of the tubular shaped alkalizer. The device may have an internal impeller to track the consumption of water. The impeller data may be transmitted to the smart phone app, where the user may monitor their hydration. The device may have a cap that may be removed from a tip of the device to reveal a battery housing and Bluetooth transmitter. The device may include the ability to add flavor with a flavoring agent, which may be inserted into a flavor compartment of the device. This flavoring agent may be any number of items, including tablets, candies such as hard candies or suckers, beads, powders, or oil capsules, including but not limited to essential oil capsules and/or therapeutic oil capsules, and may be formed from either or both organic or non-organic items, although organic tablets are preferred. Water may move through the flavoring compartment and around the flavoring agent to dissolve the flavor into the water. Thus, the device may fulfill the need for water hydration, hydration tracking, and natural water flavoring.

Among other things, it is an advantage of the invention to provide a drinking straw device to ionize, filter, and flavor drinking water that does not suffer from any of the problems or deficiencies associated with prior solutions. It is further an advantage of the invention to have a carbon filter to remove contaminants and impurities in the water to ensure a more purified drinking water.

The invention is a convenient tool to provide pure water, hydration tracking, and organic water flavoring. The device's main features include ionizing with the alkaline feature, filtering with the carbon filter, tracking consumption through communication with a smart phone software application or other device, and the addition of flavoring. The alkaline feature may ionize water by changing the pH level of the water in which the device is placed. The filtering feature may be a carbon filter that may remove impurities and other contaminants. The device's tip may have an internal impeller, electronic battery, and Bluetooth transmitter that may allow the user to track water intake by transmitting data to the smart phone app. This app may track hydration level to keep the user informed regarding their consumption. The device may flavor water with a flavoring agent that is inserted into a flavor compartment of the device. Water may move through the compartment and around the agent to dissolve the flavor into the water.

Referring to the drawings, FIGS. 1 through 9 show the straw-like device 10 of the present invention. The device 10 may be primarily straw-shaped and may include a cavity allowing a user of the device 10 to ingest liquids within a container via a sucking action. The device 10 may be primarily designed for water ingestion, although it may be used for the ingestion of any liquid.

The device 10 may include a main body portion 100, a top end 101, and a bottom end 102. The main body portion 100 may have the general shape of a hollow cylinder. In other words, the main body portion 100 may be tubular. The main body portion 100 may include an ionizer 130 that, when activated, has the ability to ionize water to alter its pH to an alkaline level. In particular, the ionizer 130 may be a tube of material, such as stainless steel, with a grid of holes 131, as shown. The ionizer 130 may house a variety of minerals, allowing the liquid to be ionized while it travels through the minerals or as the straw sits in the liquid. The minerals may include water-soluble calcium carbonate ore, tourmaline ceramics, coral fossil (weathered coral), maifanshi, and/or dechlorinating ceramics. In particular, the ionizer 130 may utilize a combination of these minerals. The ionizer 130 may be removable such that a user may replace it after it has been fully used. Alternately, the minerals may be accessible within the ionizer 130 for replacement of just the minerals by the user.

The bottom end 102 may terminate in an end cap 121 with an aperture 120 therethrough, allowing liquid to enter the main body portion 100. The end cap 121 may be held in place at the bottom end 102 via friction fit, as shown, or alternately or additionally by threaded assembly, via a mechanical assembly device such as a screw or glue, and/or otherwise as desired.

The main body portion 100 may house the carbon filtration device 103. The carbon filtration device 103 may be cylindrical and may slide into the center of the tubular main body portion 100. When in place, the carbon filtration device 103 and the main body portion 100 may be generally coaxial. The carbon filtration device 103 may be held in place by the end cap 121 such that liquid flowing through the aperture 120 must travel through the carbon filtration device 103 to move through the main body portion 100 to the top end 101. The end cap 121 may incorporate an O-ring to prevent the passage of liquid through the device 10 without passing through the filtration device 103.

The carbon filtration device 103 may utilize any desired activated carbon, such as coconut shell, coal, or wood activated carbon. In particular, the carbon filtration device 130 may comprise an extruded rod of coconut shell activated carbon, coal activated carbon, or wood activated carbon. Alternately, the carbon filtration device 130 may comprise granular activated carbon enclosed within the ionizing minerals.

The top end 101 may terminate in a housing 112, which may likewise be tubular and may have a generally similar outer diameter as the main body portion 100. The housing 112 may attach to the top end 101 of the main body portion 100 via threaded assembly, as shown, or alternately or additionally via friction fit, via a mechanical assembly device such as a screw or glue, and/or otherwise as desired. The housing 112 may form a cavity 113 to hold a flavoring component 114. The housing 112 may have a horizontal component acting as a shelf to hold the flavoring component 114, where the horizontal component has one or more openings therethrough for the passage of liquid passing through the device 10. A second horizontal component with openings therethrough located above the cavity 113 may prevent the flavoring component 114 from moving upward out of the cavity 113 during use. The cavity 113 may be accessible by the user for placement of the flavoring component 114. The flavoring component 114 within the housing 112 may preferably be a tablet, as shown, comprised of organic flavoring components, but may be selected from any number of additional flavoring elements including one or more organic and non-organic beads, candies, suckers, powders, oils, or tablets.

A tip 104 may attach to the housing 112 at its base 108, such as by threaded assembly, as shown, or alternately or additionally via friction fit, via a mechanical assembly device such as a screw or glue, and/or otherwise as desired. The tip 104 may attach to the housing 112 the same way the housing 112 attaches to the top end 101, allowing the tip 104 to be attached directly to the top end 101, if desired, for use of the device 10 without the housing 112 or flavoring component 114. The tip 104 may be hollow from its base 108 to an aperture 122, allowing liquid to travel through the tip 104 by entering the base 108 and exiting the aperture 122. The tip 104 may angle, as shown, to allow ingestion of liquids through the device 10 and out the aperture 122 at a comfortable angle for the user.

Figure 5:
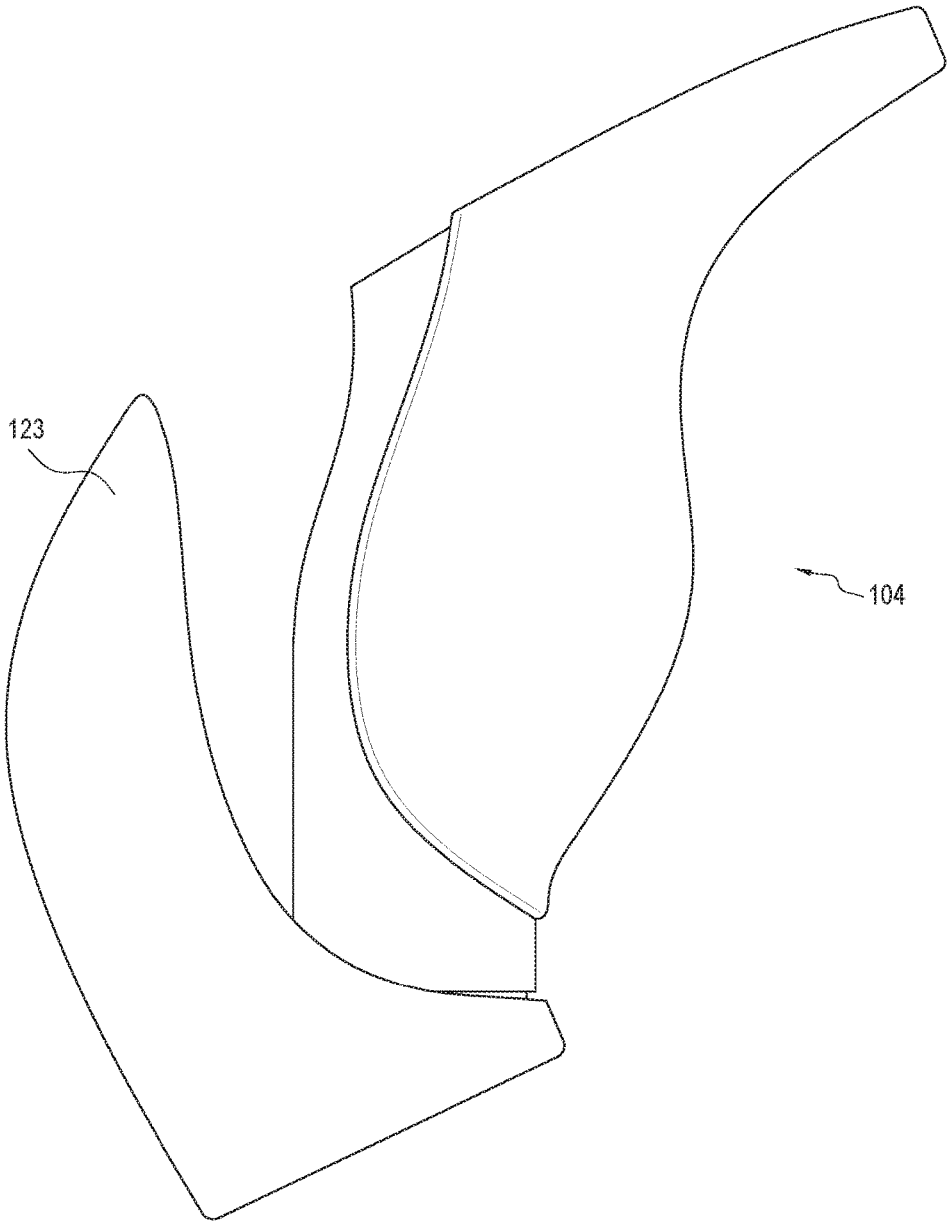
FIG. 5 is a side view of the tip of the drinking straw with the cap in an open position.
Figure 6:
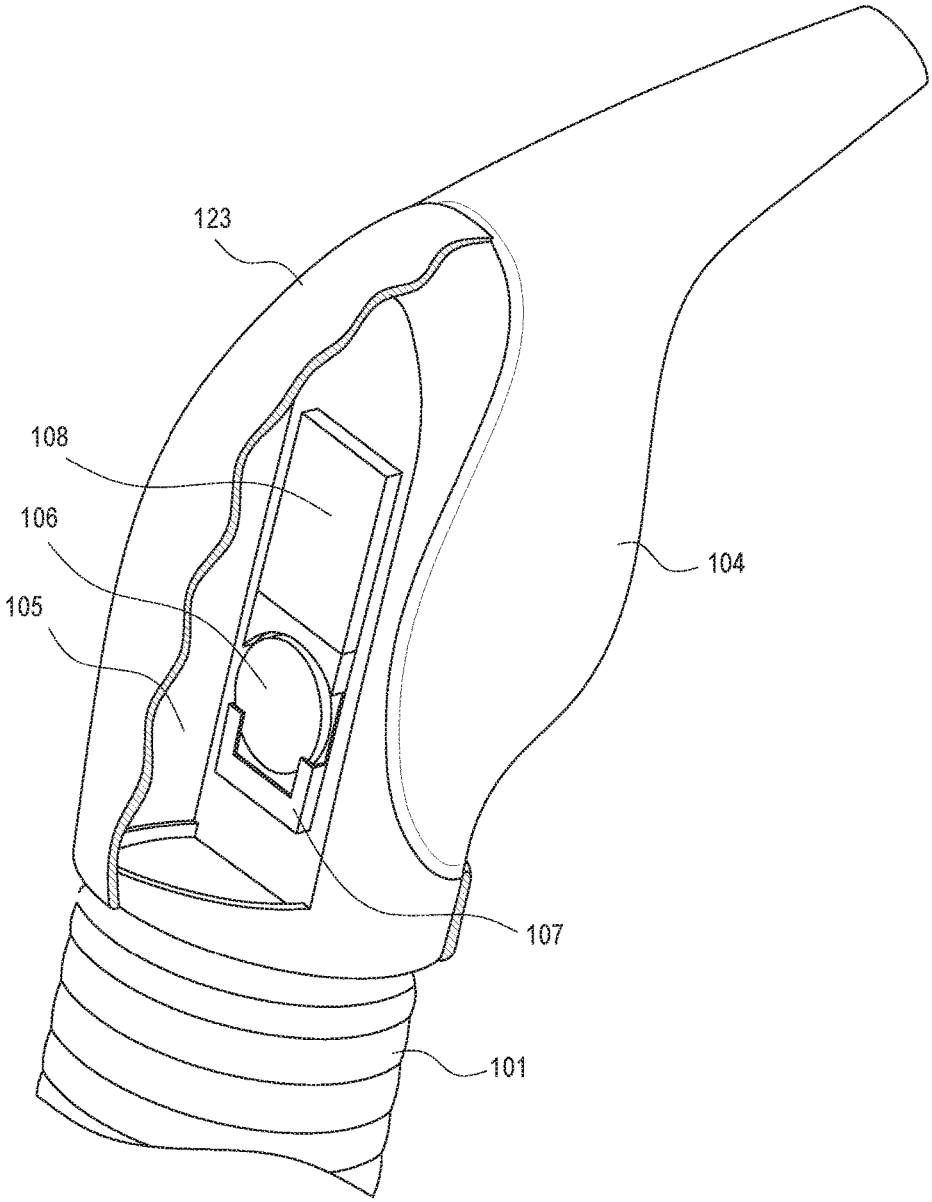
FIG. 6 is a cut away close-up perspective view of the tip of the drinking straw.
Figure 7:
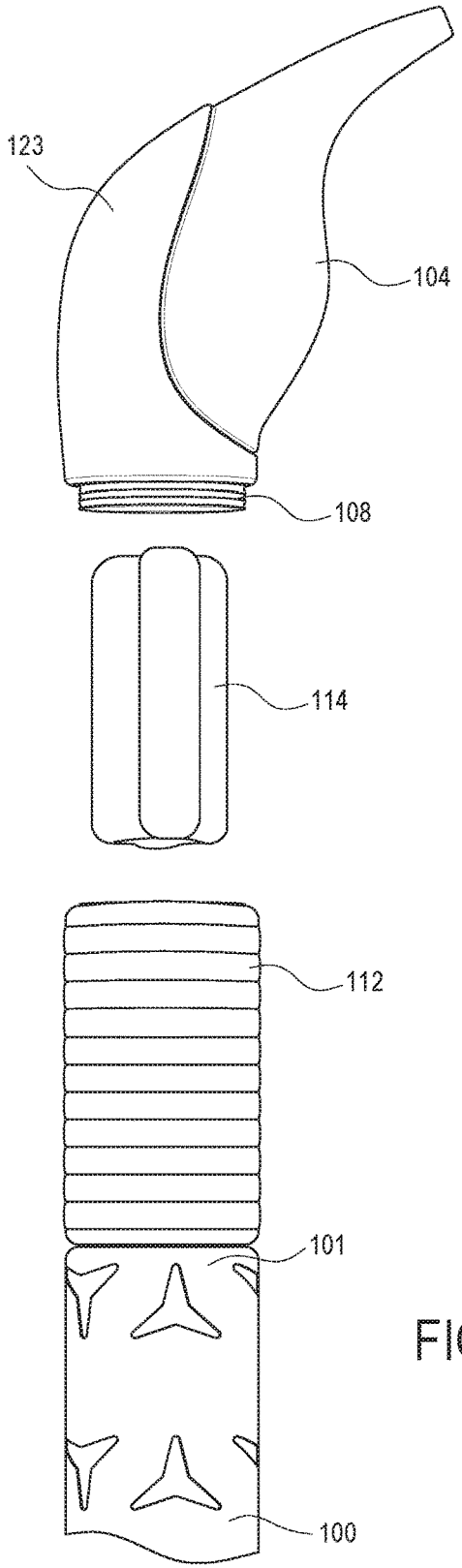
FIG. 7 is an exploded close-up side view of the tip, flavoring component, and flavoring housing of the drinking straw.
Figure 8:
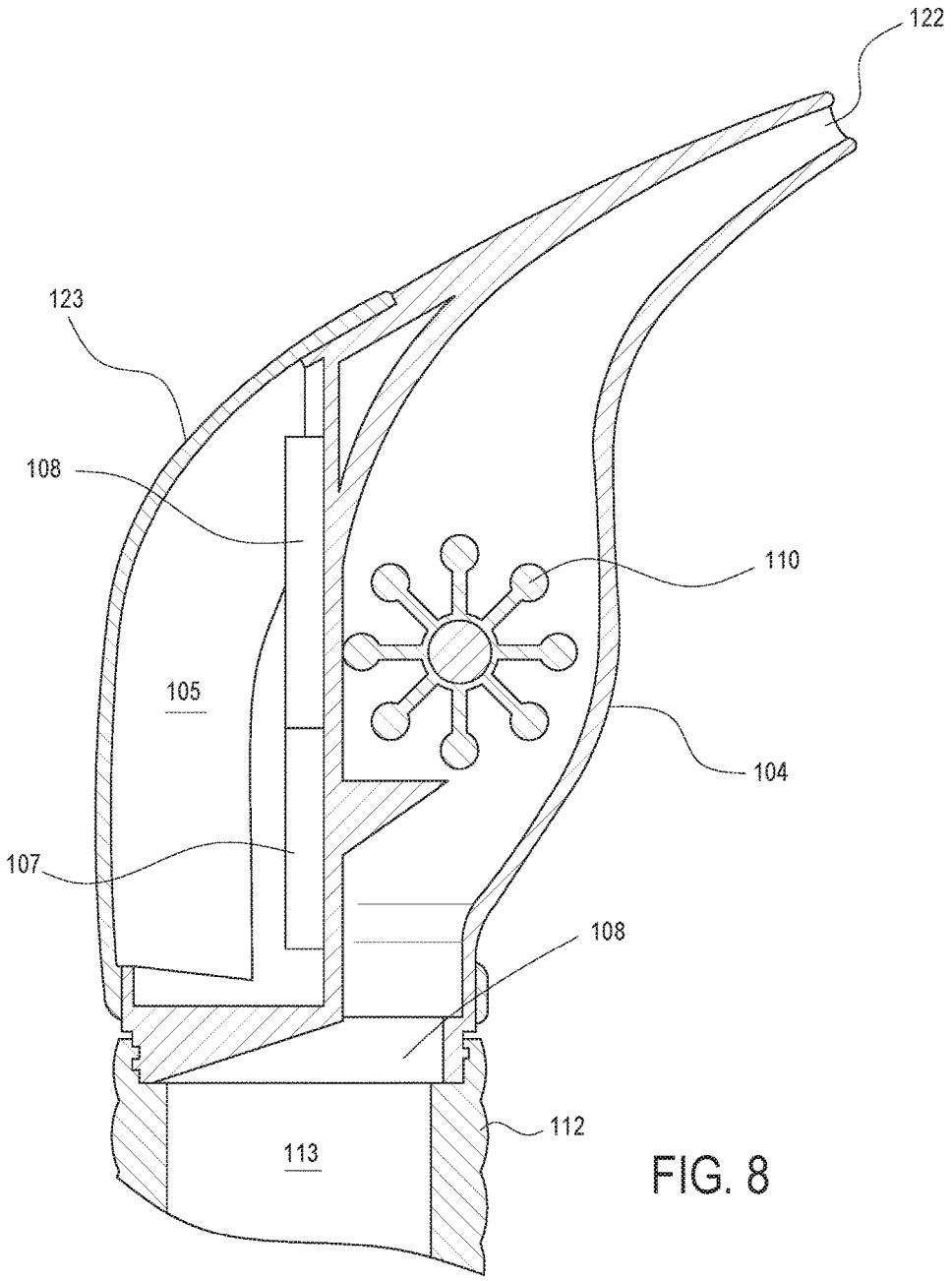
FIG. 8 is a close-up section view of the tip and flavoring housing of the drinking straw.

The tip 104 may have a cap 123 defining a cavity 105 for the placement of a power source, such as one or more batteries 106 in a battery housing 107, and electrical components 108, such as a Bluetooth transmitter, a small processor such as an Arduino microcontroller, and a hall effect sensor. The cavity 105 may be accessible by a user, such as by opening the cap 123 as shown in FIG. 5. The cavity 105 may not be in fluid communication with the interior of the top 104 where the liquid travels, such that the power source 106 and electrical components 108 may stay dry during use.

The tip 104 may house an impeller 110 located within the path of liquid traveling from the base 108 to the aperture 122 such that the liquid turns the impeller 110 as it passes. As used herein, "impeller" refers to a rotating device with paddle or vane components, such as a water wheel, that is turned by the passage of fluid thereby. A wall extending from the sidewall of the tip 104 may ensure that all liquid passes one side of the impeller 110 only, allowing the impeller 110 to spin in only one direction. One or more magnets may be imbedded within the vanes of the impeller 110 such that the hall effect sensor that is part of the electrical components 108 in the cavity 105 may sense the passing of the magnetic fields and send a signal to the processor. The processor may count the number of signals and communicate via the Bluetooth transmitter with a software application on a smartphone or other electronic device 125, which may then translate the information into the amount of liquid passing through the tip 104 and, consequently, consumed by the user.

Figure 9:
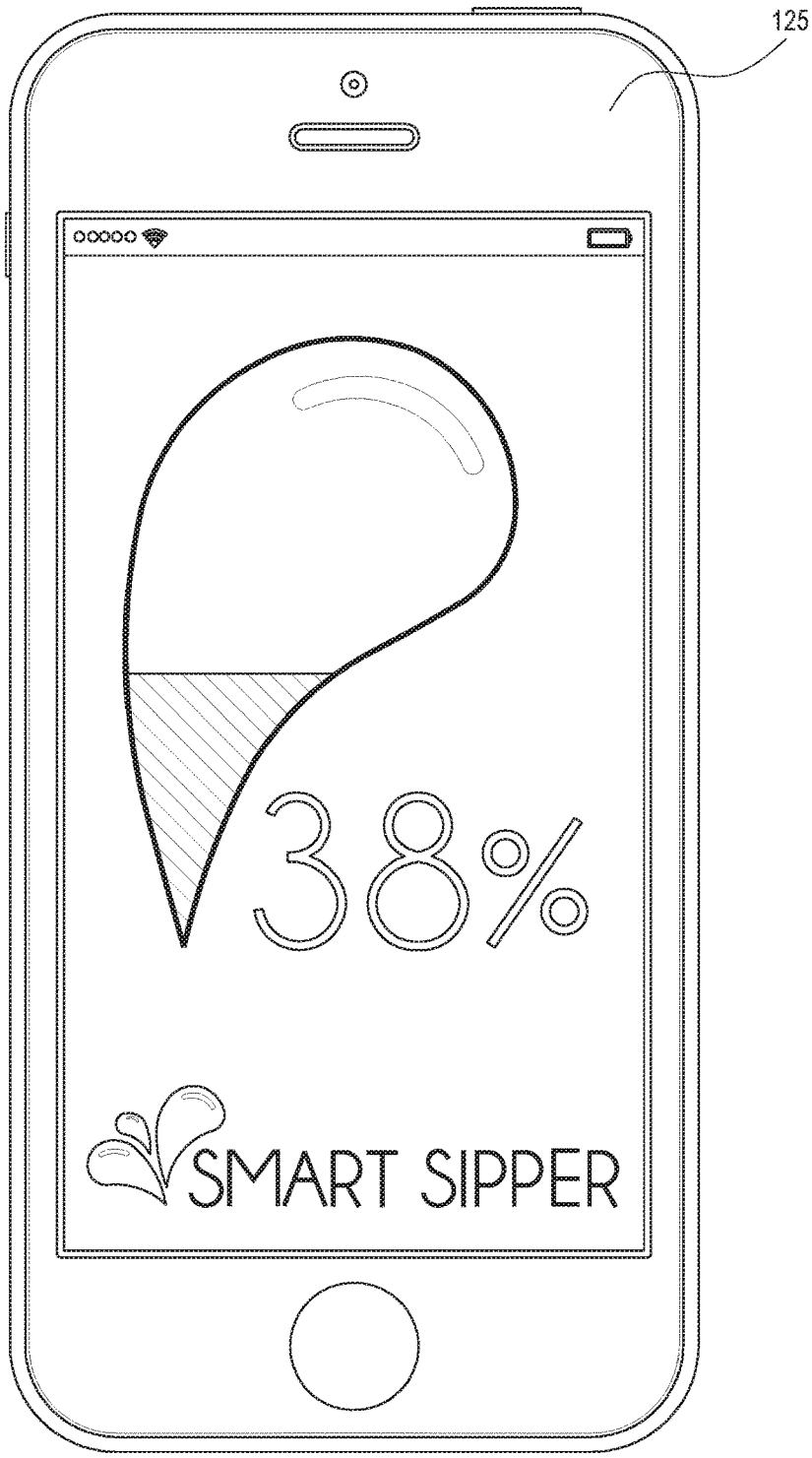
FIG. 9 is a plan view of a smart phone showing the user's hydration level via the app.

During use, the bottom end 102 may be placed within the liquid and the user may draw liquid into the device 10 via the aperture 120. The liquid may move up the device 10 and through the carbon filtration device 103, through the end 101, and through the housing 112, where it may be flavored by the flavoring component 114. The liquid may travel out of the housing 112 and through a tip 104, passing the impeller 110 therein and exiting out of the aperture 122 in the tip 104 and into the use's mouth. The impeller 110 may allow for a measurement of the quantity of liquid consumed and may be in communication with the software application on the electronic device 125, such as a smartphone. The user's progress toward his or her hydration goals may then be displayed on the electronic device 125, as shown in FIG. 9.

Whereas, the devices and methods have been described in relation to the drawings and claims, it should be understood that other and further modifications, apart from those shown or suggested herein, may be made within the spirit and scope of this invention.

What is claimed is:

1. A drinking straw device comprising:

a tubular body with a top end and a bottom end;

an impeller positioned such that fluid passing through the body makes the impeller spin;

a processor capable of calculating how much fluid has passed through the body based on how many times the impeller spins;

a transmitter, where the transmitter is in communication with the processor; and a software application in communication with the processor via the transmitter where the software application is capable of tracking a user's ingestion of fluid through the body based on how many times the impeller spins.

2. The drinking straw device of claim 1 further comprising:

one or more magnets in the impeller; and a hall effect sensor positioned such that it is capable of sensing the magnets in the impeller as the impeller spins, where the hall effect sensor is in communication with the processor.

3. The drinking straw device of claim 1 where the transmitter is a Bluetooth transmitter.

4. The drinking straw device of claim 1 further comprising a filter located within the body.

5. The drinking straw device of claim 1 further comprising a housing attached to the top end of the body.

6. The drinking straw device of claim 5 further comprising a flavor component within the housing.

7. The drinking straw device of claim 5 where the housing is generally tubular and generally coaxial with the body.

8. The drinking straw device of claim 1 further comprising a tip attached to the top end, where:

the impeller is located within the tip;

the tip has an open base and an opposing aperture;

the base is in fluid communication with the aperture such that fluid entering the tip at the base is capable of exiting the tip at the aperture;

the impeller is located between the base and the aperture; and the tip is in fluid communication with the body such that fluid is capable of flowing into the bottom end of the body, through the body, though the tip, and out the aperture in the tip.

9. The drinking straw device of claim 8 further comprising a flavor component housing located between the top end of the body and the base of the tip and in fluid communication with the body and the tip such that fluid is capable of flowing into the bottom end of the body, through the body, through the housing, though the tip, and out the aperture in the tip.

10. The drinking straw device of claim 8 further comprising:

one or more magnets in the impeller; and a hall effect sensor positioned such that it is capable of sensing the magnets in the impeller as the impeller spins, where the hall effect sensor is in communication with the processor.

11. A drinking straw device comprising:

a tubular body with a top end and a bottom end, where the body comprises an ionizer;

an impeller positioned such that fluid passing through the body makes the impeller spin; and a processor capable of calculating how much fluid has passed through the body based on how many times the impeller spins.

12. The drinking straw device of claim 10 further comprising:

one or more magnets in the impeller; and a hall effect sensor positioned such that it is capable of sensing the magnets in the impeller as the impeller spins, where the hall effect sensor is in communication with the processor.

13. The drinking straw device of claim 10 further comprising a transmitter, where the transmitter is in communication with the processor.

14. The drinking straw device of claim 10 where the transmitter is a Bluetooth transmitter.

15. The drinking straw device of claim 10 further comprising a filter located within the body.

16. The drinking straw device of claim 10 further comprising an end cap removably attached to the bottom end of the body by friction fit, where the end cap has at least one aperture therethrough.

17. The drinking straw device of claim 10 further comprising a housing attached to the top end of the body.

18. The drinking straw device of claim 17 further comprising a flavor component within the housing.

19. The drinking straw device of claim 17 where the housing is generally tubular and generally coaxial with the body.

20. The drinking straw device of claim 10 further comprising a tip attached to the top end, where:

the impeller is located within the tip;

the tip has an open base and an opposing aperture;

the base is in fluid communication with the aperture such that fluid entering the tip at the base is capable of exiting the tip at the aperture;

the impeller is located between the base and the aperture; and the tip is in fluid communication with the body such that fluid is capable of flowing into the bottom end of the body, through the body, though the tip, and out the aperture in the tip.

21. The drinking straw device of claim 20 further comprising a flavor component housing located between the top end of the body and the base of the tip and in fluid communication with the body and the tip such that fluid is capable of flowing into the bottom end of the body, through the body, through the housing, though the tip, and out the aperture in the tip.

22. The drinking straw device of claim 20 further comprising:

one or more magnets in the impeller;

a hall effect sensor positioned such that it is capable of sensing the magnets in the impeller as the impeller spins, where the hall effect sensor is in communication with the processor;

a transmitter, where the transmitter is in communication with the processor; and a software application in communication with the processor via the transmitter where the software application is capable of tracking a user's ingestion of fluid through the body based on how many times the impeller spins.

23. A drinking straw device comprising:

a tubular body with a top end and a bottom end;

an impeller positioned such that fluid passing through the body makes the impeller spin;

a processor capable of calculating how much fluid has passed through the body based on how many times the impeller spins; and an end cap removably attached to the bottom end of the body by friction fit, where the end cap has at least one aperture therethrough.

24. The drinking straw device of claim 12 further comprising:

one or more magnets in the impeller; and a hall effect sensor positioned such that it is capable of sensing the magnets in the impeller as the impeller spins, where the hall effect sensor is in communication with the processor.

25. The drinking straw device of claim 12 further comprising a transmitter, where the transmitter is in communication with the processor.

26. The drinking straw device of claim 25 where the transmitter is a Bluetooth transmitter.

27. The drinking straw device of claim 12 further comprising a filter located within the body.

28. The drinking straw device of claim 12 further comprising a housing attached to the top end of the body.

29. The drinking straw device of claim 28 further comprising a flavor component within the housing.

30. The drinking straw device of claim 28 where the housing is generally tubular and generally coaxial with the body.

31. The drinking straw device of claim 12 further comprising a tip attached to the top end, where:

the impeller is located within the tip;

the tip has an open base and an opposing aperture;

the base is in fluid communication with the aperture such that fluid entering the tip at the base is capable of exiting the tip at the aperture;

the impeller is located between the base and the aperture; and the tip is in fluid communication with the body such that fluid is capable of flowing into the bottom end of the body, through the body, though the tip, and out the aperture in the tip.

32. The drinking straw device of claim 31 further comprising a flavor component housing located between the top end of the body and the base of the tip and in fluid communication with the body and the tip such that fluid is capable of flowing into the bottom end of the body, through the body, through the housing, though the tip, and out the aperture in the tip.

33. The drinking straw device of claim 31 further comprising:

one or more magnets in the impeller;

a hall effect sensor positioned such that it is capable of sensing the magnets in the impeller as the impeller spins, where the hall effect sensor is in communication with the processor;

a transmitter, where the transmitter is in communication with the processor; and a software application in communication with the processor via the transmitter where the software application is capable of tracking a user's ingestion of fluid through the body based on how many times the impeller spins.

* * * * *